US009460824B2

(12) United States Patent
Liu et al.

(10) Patent No.: US 9,460,824 B2
(45) Date of Patent: Oct. 4, 2016

(54) STRETCHABLE CONDUCTIVE FILM BASED ON SILVER NANOPARTICLES

(71) Applicant: XEROX CORPORATION, Norwalk, CT (US)

(72) Inventors: Ping Liu, Mississauga (CA); Yiliang Wu, Mississauga (CA); Sandra J. Gardner, Oakville (CA)

(73) Assignee: XEROX CORPORATION, Norwalk (UY)

( * ) Notice: Subject to any disclaimer, the term of this patent is extended or adjusted under 35 U.S.C. 154(b) by 94 days.

(21) Appl. No.: 14/260,126

(22) Filed: Apr. 23, 2014

(65) Prior Publication Data

US 2015/0310954 A1 Oct. 29, 2015

(51) Int. Cl.
*H01B 1/02* (2006.01)
*H01B 13/00* (2006.01)

(52) U.S. Cl.
CPC ..... *H01B 1/02* (2013.01); *H01B 13/0016* (2013.01); *H01B 13/0036* (2013.01)

(58) Field of Classification Search
CPC ..... C08L 2201/56; C08L 2203/206; C08L 2666/80; C08L 75/04; C08K 3/08; H01L 2224/29339; H01L 2224/2929; H01L 2224/2954; H01B 13/0016; H01B 13/0036; H01B 1/02; H01B 1/22; Y10T 428/31554; Y10T 428/31609
USPC ..... 428/423.1, 423.3, 425.9; 156/229; 427/125, 126.4, 371, 375, 376.6, 427/388.1, 388.5
See application file for complete search history.

(56) References Cited

U.S. PATENT DOCUMENTS

| | | | | |
|---|---|---|---|---|
| 7,270,694 | B2 | 9/2007 | Li et al. | |
| 7,494,608 | B2 | 2/2009 | Li et al. | |
| 2005/0136231 | A1* | 6/2005 | Voss-Kehl et al. | 428/209 |
| 2006/0181600 | A1* | 8/2006 | Bourdelais et al. | 347/199 |
| 2007/0099357 | A1 | 5/2007 | Li et al. | |
| 2007/0207335 | A1* | 9/2007 | Karandikar et al. | 428/560 |
| 2009/0148600 | A1 | 6/2009 | Li et al. | |
| 2009/0181183 | A1 | 7/2009 | Li et al. | |
| 2011/0135808 | A1* | 6/2011 | Liu et al. | 427/58 |
| 2012/0043512 | A1 | 2/2012 | Liu et al. | |

* cited by examiner

*Primary Examiner* — Thao T Tran
(74) *Attorney, Agent, or Firm* — MH2 Technology Law Group LLP

(57) ABSTRACT

An article of manufacture includes a substrate and a stretchable, conductive film. The stretchable, conductive film includes a plurality of annealed silver nanoparticles disposed on the substrate. The conductive film can be formed from a liquid composition comprising silver nanoparticles in a decalin solvent. The conductive film can further include a first conductivity associated with an as-annealed shape of the conductive film, and the film can include a second conductivity upon being stretched in at least one direction beyond the as-annealed shape.

19 Claims, 2 Drawing Sheets

STRETCHABLE CONDUCTIVE FILM BASED ON SILVER NANOPARTICLES

BACKGROUND

Stretchable electronics have attracted great interest from both academia and industry. This new class of electronics has potential applications in many areas such as stretchable cyber skins for robotic devices, wearable electronics for functional clothes, stretchable sensors, and flexible electronic displays. Stretchability of materials is especially desired in electronic devices which need to be in contact with human body or to be conformable with curved surfaces. However, conventional electronic devices are usually made from rigid materials and they are not able to be stretched, folded, and twisted.

Silver is of particular interest as a conductive element for electronic devices because silver is much lower in cost than gold and silver possesses much better environmental stability than copper. Solution-processable conductors are of great interest for use in such electronic applications. Silver nanoparticle-based inks represent a promising class of materials for electronics applications. However, most silver (and gold) nanoparticles often require large molecular weight stabilizers to ensure proper solubility and stability in solution. These large molecular weight stabilizers inevitably raise the annealing temperatures of the silver nanoparticles above 200° C. In order to burn off the stabilizers, which temperatures are incompatible with most low-cost plastic substrates such as polyethylene terephthalate (PET) and polyethylene naphthalate (PEN) that the solution may be coated onto and can cause damage thereto.

U.S. Pat. No. 7,270,694, which is hereby incorporated by reference herein in its entirety, discloses a process comprising reacting a silver compound with a reducing agent comprising a hydrazine compound in the presence of a thermally removable stabilizer in a reaction mixture comprising the silver compound, the reducing agent, the stabilizer, and an optional solvent, to form a plurality of silver-containing nanoparticles with molecules of the stabilizer on the surface of the silver-containing nanoparticles.

U.S. Pat. No. 7,494,608, which is hereby incorporated by reference herein in its entirety, discloses a composition comprising a liquid and a plurality of silver-containing nanoparticles with a stabilizer, wherein the silver-containing nanoparticles are a product of a reaction of a silver compound with a reducing agent comprising a hydrazine compound in the presence of a thermally removable stabilizer in a reaction mixture comprising the silver compound, the reducing agent, the stabilizer, and an organic solvent wherein the hydrazine compound is a hydrocarbyl hydrazine, a hydrocarbyl hydrazine salt, a hydrazide, a carbazate, a sulfonohydrazide, or a mixture thereof, and wherein the stabilizer includes an organoamine.

Silver nanoparticles have also been prepared, for example as described in U.S. Pub. No. 2007/0099357 A1, incorporated by reference herein in its entirety, using 1) amine-stabilized silver nanoparticles and 2) exchanging the amine stabilizer with a carboxylic acid stabilizer.

There is a great need to develop new materials that can overcome limitations of those currently used in rigid, conventional electronic devices.

SUMMARY

In an embodiment there is an article of manufacture that includes a substrate and a stretchable, conductive film. The stretchable, conductive film includes a plurality of annealed silver nanoparticles disposed on the substrate. The conductive film can be formed from a liquid composition comprising decalin solvent. The conductive film can further include a first conductivity associated with an as-annealed shape of the conductive film, and the film can comprise a second conductivity upon being stretched in at least one direction beyond the as-annealed shape.

In another embodiment, there is a process for making an article of manufacture. The process can include dispersing organoamine silver nanoparticles in a solvent to form an ink, depositing a layer of the ink on a substrate surface, annealing the layer to form a stretchable, conductive film comprising annealed silver nanoparticles, and stretching the stretchable conductive film such that it attains a second conductivity. The stretchable, conductive film can have an as-annealed shape and a first conductivity associated with the as-annealed shape.

In yet another embodiment there an article of manufacture comprising a surface and a stretchable, conductive film disposed on the surface. The stretchable, conductive film can include a plurality of annealed conductive metal nanoparticles. The stretchable, conductive film can also have a first conductivity associated with an as-annealed shape of the stretchable, conductive film. The stretchable, conductive film can comprise a second conductivity upon being stretched in at least one direction beyond the as-annealed shape.

DETAILED DESCRIPTION

Figure 1A:
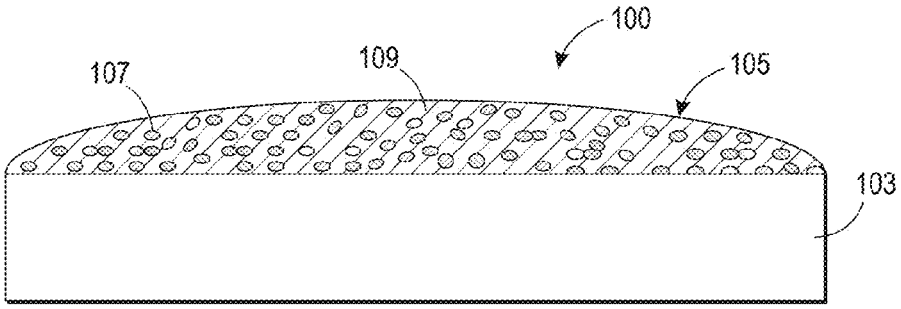
FIG. 1A shows a layer of ink comprising silver nanoparticles deposited on a surface of a substrate, in accordance with embodiments disclosed herein.

The present embodiments provide for conductive films, methods of making conductive films and articles of manufacture comprising the conductive films. The conductive films can comprise silver nanoparticles, for example, silver nanoparticles deposited from a nanoparticle ink composition and formed as a film on a stretchable substrate. The ink composition can be comprised of a silver nanoparticle solution that may contain silver nanoparticles, a stabilizer and a solvent. The silver nanoparticle ink composition can be selected from a silver nanoparticle ink composition such as that disclosed in U.S. Pub. No. 2012/0043512 and/or a silver nanoparticles ink composition such as that disclosed in U.S. Pub. No. 2011/0135808, each of which is hereby incorporated by reference herein in its entirety.

Upon annealing the ink layer, the silver nanoparticles become annealed to form a conductive film. The conductive film can substantially conform to a surface of the substrate, even as the substrate is stretched, and remain conductive.

The conductive film can have an original shape, such as a shape the film attains upon becoming adequately annealed, and a first conductivity corresponding to the initial shape. Subsequently, the film can be stretched, for example, as it remains associated to the surface of the underlying substrate and the substrate is stretched by about 5% to about 10% in at least one direction. Upon being stretched, for example upon reaching a stretched condition or upon reaching a subsequent unstretched condition, the films conductivity is a second conductivity. In an embodiment, the second conductivity is no less than the first conductivity. In an embodiment, the second conductivity is greater than the first conductivity.

Silver Nanoparticles

The term "nano" as used in "silver nanoparticles" refers to, for example, a particle size of less than about 1,000 nm, such as, for example, from about 0.5 nm to about 1,000 nm, for example, from about 1 nm to about 500 nm, from about 1 nm to about 100 nm, from about 1 nm to about 25 nm or from about 1 to about 10 nm. The particle size refers to the average diameter of the metal particles, as determined by TEM (transmission electron microscopy) or other suitable method. Generally, a plurality of particle sizes may exist in the silver nanoparticles obtained from the process described herein. In embodiments, the existence of different sized silver nanoparticles is acceptable.

The silver nanoparticles may have a stability (that is, the time period where there is minimal precipitation or aggregation of the silver nanoparticles in the ink composition) of, for example, at least from about 5 days to about 1 month, from about 1 week to about 6 months, from about 1 week to over 1 year. The stability can be monitored using a variety of methods, for example, a dynamic light scattering method that probes the particle size, a simple filtration method using a determined filter pore size, for example 1 micron, to evaluate the solid on the filter.

Additional metal nanoparticles in place of, or along with the, silver nanoparticles may also be used, such as, for example, Al, Au, Pt, Pd, Cu, Co, Cr, In, and Ni, particularly the transition metals, for example, Au, Pt, Pd, Cu, Cr, Ni, and mixtures thereof. Furthermore, the ink composition may also include a silver nanoparticle composite or a metal nanoparticle composite, such as, for example, Au—Ag, Ag—Cu, Ag—Ni, Au—Cu, Au—Ni, Au—Ag—Cu, and Au—Ag—Pd. The various components of the composites may be present in an amount ranging for example from about 0.01% to about 99.9% by weight, particularly from about 10% to about 90% by weight.

The silver and/or other metal nanoparticles may be prepared from the chemical reduction of a metal compound. Any suitable metal compound can be used for the process described herein. Examples of the metal compound include metal oxide, metal nitrate, metal nitrite, metal carboxylate, metal acetate, metal carbonate, metal perchlorate, metal sulfate, metal chloride, metal bromide, metal iodide, metal trifluoroacetate, metal phosphate, metal trifluoroacetate, metal benzoate, metal lactate, metal hydrocarbysulfonate or combinations thereof.

The weight percentage of the silver nanoparticles in the ink composition may be from, for example, about 10 weight percent to about 80 weight percent, from about 30 weight percent to about 60 weight percent or from about 40 weight percent to about 70 weight percent.

The ink composition described herein contains a stabilizer that is associated with the surface of the silver nanoparticles and is not removed until the annealing of the silver nanoparticles during formation of metal features on a substrate. The stabilizer may be organic.

In embodiments, the stabilizer is physically or chemically associated with the surface of the silver nanoparticles. In this way, the silver nanoparticles have the stabilizer thereon outside of a liquid solution. That is, the nanoparticles with the stabilizer thereon may be isolated and recovered from a reaction mixture solution used in forming the nanoparticles and stabilizer complex. The stabilized nanoparticles may thus be subsequently readily and homogeneously dispersed in a solvent for forming a printable liquid.

As used herein, the phrase "physically or chemically associated" between the silver nanoparticles and the stabilizer may be a chemical bond and/or other physical attachment. The chemical bond may take the form of, for example, covalent bonding, hydrogen bonding, coordination complex bonding, or ionic bonding, or a mixture of different chemical bonds. The physical attachment may take the form of, for example, van der Waals' forces or dipole-dipole interaction, or a mixture of different physical attachments.

The term "organic" in "organic stabilizer" refers to, for example, the presence of carbon atom(s), but the organic stabilizer may include one or more non-metal heteroatoms such as nitrogen, oxygen, sulfur, silicon, halogen, and the like. The organic stabilizer may be an organoamine stabilizer such as those described in U.S. Pat. No. 7,270,694, which is incorporated by reference herein in its entirety. Examples of the organoamine are an alkylamine, such as for example butylamine, pentylamine, hexylamine, heptylamine, octylamine, nonylamine, decylamine, hexadecylamine, undecylamine, dodecylamine, tridecylamine, tetradecylamine, diaminopentane, diaminohexane, diaminoheptane, diaminooctane, diaminononane, diaminodecane, diaminooctane, dipropylamine, dibutylamine, dipentylamine, dihexylamine, diheptylamine, dioctylamine, dinonylamine, didecylamine, methylpropylamine, ethylpropylamine, propylbutylamine, ethylbutylamine, ethylpentylamine, propylpentylamine, butylpentylamine, tributylamine, trihexylamine, and the like, or mixtures thereof.

Examples of other organic stabilizers include, for example, thiol and its derivatives, —OC(S)SH (xanthic acid), polyethylene glycols, polyvinylpyridine, polyninylpyrolidone, and other organic surfactants. The organic stabilizer may be selected from the group consisting of a thiol such as, for example, butanethiol, pentanethiol, hexanethiol, heptanethiol, octanethiol, decanethiol, and dodecanethiol; a dithiol such as, for example, 1,2-ethanedithiol, 1,3-propanedithiol, and 1,4-butanedithiol; or a mixture of a thiol and a dithiol. The organic stabilizer may be selected from the group consisting of a xanthic acid such as, for example, O-methylxanthate, O-ethylxanthate, O-propylxanthic acid, O-butylxanthic acid, O-pentylxanthic acid, O-hexylxanthic acid, O-heptylxanthic acid, O-octylxanthic acid, O-nonylxanthic acid, O-decylxanthic acid, O-undecylxanthic acid, O-dodecylxanthic acid. Organic stabilizers containing a pyridine derivative (for example, dodecyl pyridine) and/or organophosphine that can stabilize metal nanoparticles may also be used as a potential stabilizer.

Further examples of stabilized silver nanoparticles may include: the carboxylic acid-organoamine complex stabilized silver nanoparticles, described in U.S. Patent Application Pub. No. 2009/0148600; the carboxylic acid stabilizer silver nanoparticles described in U.S. Patent App. Pub. No. 2007/0099357 A1, and the thermally removable stabilizer and the UV decomposable stabilizers described in U.S. Patent Application Pub. No. 2009/0181183, each of which is incorporated by reference herein in its entirety.

The weight percentage of the organic stabilizer in the silver nanoparticle (including only the silver nanoparticle and the stabilizer, excluding the solvent) may be from, for example, about 3 weight percent to about 80 weight percent, from about 5 weight percent to about 60 weight percent, from about 10 weight percent to about 50 weight percent, or from about 10 weight percent to about 30 weight percent.

In embodiments, the silver nanoparticle is an organoamine stabilized silver nanoparticle. The weight percentage of silver in the silver nanoparticle (silver and stabilizer only) is from about 60% to about 95% or from about 70% to about 90%. The weight percentage of the silver nanoparticles in the silver nanoparticle ink composition (including the solvent) is from about 10% to about 90%, including from about 30% to about 80%, from about 30% to about 70% and from about 40% to about 60%.

Solvent

The solvent should facilitate the dispersion of the stabilized silver nanoparticles and the polyvinyl alcohol derivative resins. Examples of the solvent may include, for example, aromatic hydrocarbons such as benzene, toluene, xylene, ethylbenzene, phenylcyclohexane, decalin and tetralin, an alkane, alkene or an alcohol having from about 10 to about 18 carbon atoms such as, undecane, dodecane, tridecane, tetradecane, hexadecane, dicyclohexane, 1-undecanol, 2-undecanol, 3-undecanol, 4-undecanol, 5-undecanol, 6-undecanol, 1-dodecanol, 2-dodecanol, 3-dodecanol, 4-dodecanol, 5-dodecanol, 6-dodecanol, 1-tridecanol, 2-tridecanol, 3-tridecanol, 4-tridecanol, 5-tridecanol, 6-tridecanol, 7-tridecanol, 1-tetradecanol, 2-tetradecanol, 3-tetradecanol, 4-tetradecanol, 5-tetradecanol, 6-tetradecanol, 7-tetradecanol, and the like; an alcohol, such as for example, terpineol (.alpha.-terpineol), .beta.-terpineol, geraniol, cineol, cedral, linalool, 4-terpineol, lavandulol, citronellol, nerol, methol, borneol, hexanol heptanol, cyclohexanol, 3,7-dimethyloctа-2,6-dien-1ol, 2-(2-propyl)-5-methyl-cyclohexane-1-ol and the like; isoparaffinc hydrocarbons, such as, for example, isodecane, isododecane, and commercially available mixtures of isoparaffins such as ISOPAR E, ISOPAR G, ISOPAR H, ISOPAR L and ISOPAR M (all the above-mentioned manufactured by Exxon Chemical Company), SHELLSOL (made by Shell Chemical Company), SOLTROL (made by Philips Oil Co., Ltd.), BEGASOL (made by Mobil Petroleum Co., Inc.) and IP Solvent 2835 (made by Idemitsu Petrochemical Co., Ltd.); naphthenic oils; tetrahydrofuran; chlorobenzene; dichlorobenzene; trichlorobenzene; nitrobenzene; cyanobenzene; acetonitrile; dichloromethane; N,N-dimethylformamide (DMF); and mixtures thereof. One, two, three or more solvents may be used.

In embodiments where two or more solvents are used, each solvent may be present at any suitable volume ratio or weight ratio such as for example from about 99 (first solvent):1 (second solvent) to about 1 (first solvent):99 (second solvent), including the volume ratio or weight molar ratio from about 80 (first solvent):20 (second solvent) to about 20 (first solvent):80 (second solvent). For example, the solvent may a mixture comprised of a solvent selected from the group consisting of terpineol, hexanol, heptanol, cyclohexanol, 3,7-dimethylocta-2,6-dien-1ol, 2-(2-propyl)-5-methyl-cyclohexane-1-ol, and the like, and at least one hydrocarbon solvent selected from the group consisting of decalin, hexadecane, hexadecene, 1,2,4-trimethylbenzene.

The solvent may be present in the silver ink composition in an amount of at least 10 weight percent of the composition, such as for example from about 10 weight percent to about 90 weight percent, from about 20 weight percent to about 80 weight percent, from about 30 weight percent to about 70 weight percent and from about 40 weight percent to about 60 weight percent of the composition.

In embodiments, the solvent may attack the substrate material when deposited on the substrate surface at room temperature or at an elevated temperature, such as about 30° C. to about 90° C., including from about 30° C. to about 60° C. The term "attack" or "solvent attack" as used herein is directed to a process by which solvent, for example, solvent in an ink composition comprising solvent and nanoparticles, such as silver nanoparticles, dissolves at least a portion of an underlying substrate material on which the nanoparticle ink composition is deposited, or causes at least a portion of an underlying substrate material on which the nanoparticles ink composition is deposited to swell, for example at a low swell rate. While not limited to any particular theory, it is believed that "solvent attack" over a short period of time can improve adhesion of the conductive layer on the substrate on which it is formed.

Article of Manufacture and Process for Making the Article of Manufacture

Figure 1B:
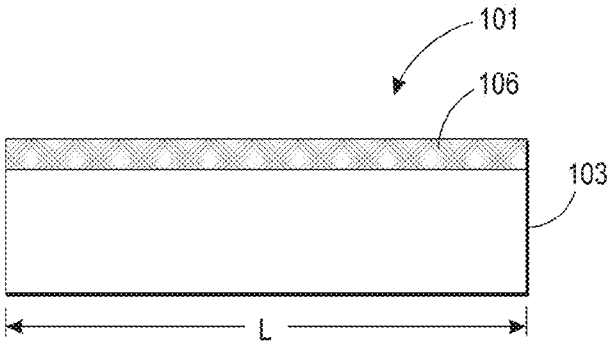
FIGS. 1B-1C show an article of manufacture comprising a stretchable, conductive film comprising silver nanoparticles disposed on a substrate, the article of manufacture shown in an unstretched condition (FIG. 1B) and in a stretched condition (FIG. 1C)
Figure 1C:
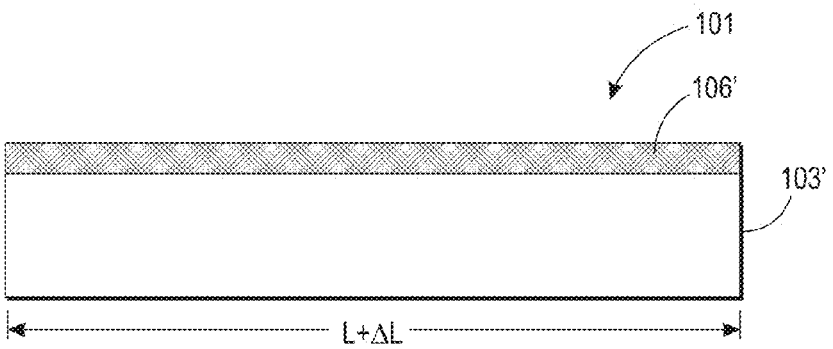

The fabrication of an article of manufacture 100 according to embodiments of the present disclosure is illustrated in FIGS. 1A-1C. For example, the fabrication can be carried out by depositing a layer of an ink composition 105, such as an ink composition comprising solvent 109 and a silver nanoparticles 105, on a substrate 103 as shown in FIG. 1A.

The ink deposition can be accomplished using any suitable liquid deposition technique at any suitable time prior to or subsequent to the formation of other optional layer or layers on the substrate.

The phrase "liquid deposition technique" refers to, for example, deposition of a composition using a liquid process such as printing or liquid coating, where the liquid is a homogeneous or heterogeneous dispersion of the silver nanoparticles in the solvent. The silver nanoparticle composition may be referred to as an ink when it is used in an inkjet printer or similar printing device to be deposited on a substrate. Examples of liquid coating processes may include, for example, spin coating, blade coating, rod coating, dip coating, and the like. Examples of printing techniques may include, for example, lithography or offset printing, gravure, flexography, screen printing, stencil printing, inkjet printing, stamping (such as microcontact printing), and the like. Liquid deposition deposits a layer or line of the composition having a thickness ranging from about 5 nanometers to about 5 millimeters, such as from about 10 nanometers to about 1000 micrometers on the substrate. The deposited silver nanoparticle composition at this stage may or may not exhibit appreciable electrical conductivity.

The silver nanoparticles can be spin-coated from the silver nanoparticle ink composition, for example, for about 10 seconds to about 1000 seconds, for about 50 seconds to about 500 seconds or from about 100 seconds to about 150 seconds, onto a substrate at a speed, for example, from about 100 revolutions per minute ("rpm") to about 5000 rpm, from about 500 rpm to about 3000 rpm and from about 500 rpm to about 2000 rpm.

The substrate upon which the silver nanoparticles inks are deposited may be any suitable substrate, including, for example, silicon, glass plate, plastic film, sheet, fabric, or paper. For structurally flexible devices, plastic substrates, such as for example polyester, polyester based polyurethane, polycarbonate, polyimide sheets and the like may be used. In other embodiments, a surface on which the silver nanoparticles inks are deposited to form a flexible, conductive film, is selected from the group consisting of a glass surface, a metal surface, a plastic surface, a rubber surface, a ceramic surface and a textile surface, for example a flexible glass surface, a flexible metal surface, a flexible plastic surface, a flexible rubber surface, a flexible ceramic surface and a flexible textile surface. The thickness of the substrate may be from amount 10 micrometers to over 10 millimeters with an exemplary thickness being from about 50 micrometers to about 2 millimeters, especially for a flexible plastic substrate and from about 0.4 to about 10 millimeters for a rigid substrate such as glass or silicon. In an embodiment, the substrate can be stretched, folded and twisted (e.g., elastic). In an example, the substrate and/or substrate surface may have elastic properties, allowing it to be stretched in at least one direction by 5% to about 100%, for example by 10% to about 50%, beyond its unstretched or natural shape, without being damaged, and may return to the unstretched or natural shape.

Heating the deposited composition at a temperature of, for example, at or below about 200° C., such as, for example, from about 80° C. to about 200° C., from about 80° C. to about 180° C., from about 80° C. to about 160° C., from about 100° C. to about 140° C., and from about 100° C. to about 120° C., for example, about 110° C., induces the silver nanoparticles to anneal and thus forms an electrically conductive layer, which is suitable for use as a stretchable, conductive film 106 of an article of manufacture 101, such as in electronic devices. The heating temperature is one that does not cause adverse changes in the properties of previously deposited layer(s) or the substrate (whether single layer substrate or multilayer substrate). Also, the low heating temperatures described above allow the use of low cost plastic substrates, which have an annealing temperature below 200° C.

The heating can be performed for a time ranging from, for example, 0.01 second to about 10 hours and from about 10 seconds to 1 hour, for example, about 40 minutes. The heating can be performed in air, in an inert atmosphere, for example, under nitrogen or argon, or in a reducing atmosphere, for example, under nitrogen containing from 1 to about 20 percent by volume hydrogen. The heating can also be performed under normal atmospheric pressure or at a reduced pressure of, for example, from about 1000 mbars to about 0.01 mbars.

As used herein, the term "heating" encompasses any technique(s) that can impart sufficient energy to the heated material or substrate to (1) anneal the silver nanoparticles and/or (2) remove the optional stabilizer from the silver nanoparticles. Examples of heating techniques may include thermal heating (for example, a hot plate, an oven, and a burner), infra-red ("IR") radiation, a laser beam, flash light, microwave radiation, or UV radiation, or a combination thereof.

Heating produces a number of effects. Prior to heating, the layer of the deposited silver nanoparticles may be electrically insulating or with very low electrical conductivity, but heating results in a stretchable, electrically conductive film 106 composed of annealed silver nanoparticles, which increases the conductivity. In embodiments, the annealed silver nanoparticles may be coalesced or partially-coalesced silver nanoparticles. In embodiments, it may be possible that in the annealed silver nanoparticles, the silver nanoparticles achieve sufficient particle-to-particle contact to form the electrically conductive layer without coalescence.

In embodiments, upon heating, a resulting electrically conductive film 106 has a thickness ranging, for example, from about 30 nanometers to about 10 microns, from about 50 nanometers to about 2 microns, from about 60 nanometers to about 300 nanometers microns, from about 60 nanometers to about 200 nanometers and from about 60 nanometers to about 150 nanometers.

A first conductivity of the resulting stretchable, conductive film 106 produced by heating the deposited silver nanoparticle ink composition is, for example, more than about 100 Siemens/centimeter ("S/cm"), more than about 1000 S/cm, more than about 2,000 S/cm, more than about 5,000 S/cm, or more than about 10,000 S/cm or more than about 50,000 S/cm. The first conductivity can correspond to a conductivity of the film 106 in an original, unstretched shape, for example an as-annealed shape, (indicated by "L" in FIG. 1B).

Subsequently, the stretchable, conductive film may be stretched, for example by remaining adhered to a surface of the substrate as the substrate is stretched 103', to form a stretched conductive film 106'. For example, the stretchable, conductive film may be stretched in at least one direction (as indicated by "L+ΔL" in FIG. 1C) from about 5% to about 50%, for example about 5% to about 20%, beyond its as-annealed shape without becoming damaged, such as without forming significant cracks or splits that could negatively impact conductivity beyond a predetermined amount, such as falling below an allowable conductivity-change tolerance. Upon stretching the conductive film, the conductivity thereof may attain a second conductivity that is different than the first conductivity. The second conductivity of the stretchable, conductive film upon being stretched is, for example, greater than the first conductivity. The second conductivity is more than about 3000 S/cm, more than about 5000 S/cm, or more than about 10000 S/cm.

In some embodiments, an adhesive force between the conductive film comprising the silver nanoparticles and the underlying substrate surface may be larger than the cohesive force of the conductive film itself. Thus, upon stretching, the film remains on the substrate due to the strong adhesion described above, even in the case in which micro-cracks form in the conductive film (i.e., even in the case where there is continuity failure of the nanoparticles conductive film due to the cohesive force).

EXAMPLES

Example 1

Synthesis of Organoamine Silver Nanoparticles 20 grams of silver acetate and 112 grams of dodecylamine were added to a 1 Liter reaction flask. The mixture was heated and stirred for about 10 to 20 minutes at 65° C. until the dodecylamine and silver acetate were dissolved. 7.12 grams of phenylhydrazine was added to the above liquid drop-wise with vigorous stirring at 55° C. The color of liquid changed from clear to dark brown indicating the formation of silver nanoparticles. The mixture was further stirred for one hour at 55° C. and then was cooled down to 40° C. After the temperature reached 40° C., 480 milliliters of methanol was added and the resulting mixture was stirred for about 10 minutes. The precipitate was filtered and rinsed briefly with methanol. The precipitate was dried under vacuum overnight at room temperature, yielding 14.3 grams of silver nanoparticles with 86.6 weight percent of silver content.

Example 2

Silver Nanoparticles Ink Preparation

Silver nanoparticle ink used for the fabrication of a stretchable, conductive film was prepared. First, organoamine stabilized silver nanoparticles of Example 1 (17.2 g)

were dissolved in toluene (4.55 g) by stirring under argon gas for about 4 hours to form a silver nanoparticles solution. An ink was prepared by adding a mixture of organic solvents including decalin, toluene, and hexadecane (15/84/1 by wt %) to the silver nanoparticles solution. The resulting mixture was mixed by rolling for about 24 hours to form a silver nanoparticles ink. The resulting silver nanoparticle ink was found to contain high silver content of 65 wt %, which was determined by removing all the solvents and organic stabilizer in a small amount silver nanoparticle ink sample (~0.5 g) at high temperature with a hot plate (250-260° C.) for ~5 min.

Stretchable, Conductive Film Formation

A stretchable, conductive film was fabricated by spin coating the silver nanoparticle ink prepared in example 2 onto a flexible polyester based polyurethane substrate (1×2 inch). The silver nanoparticles ink coating was then annealed in an oven at 110° C. for 40 min to form a conductive film. The resulting film had a conductivity of $6.8\times10^3$ S/cm before being stretched, evaluated with 4-point probe conductivity measurement. The film/substrate was then stretched by hand in different directions, to about 5-10 percent beyond its original shape, and was found to still be conductive. More interestingly, the conductivity was slightly higher (~$8.1\times10^3$ S/cm) after stretching. The silver film has excellent adhesion on the substrate—no or little damage after rubbing test.

Figure 2A:
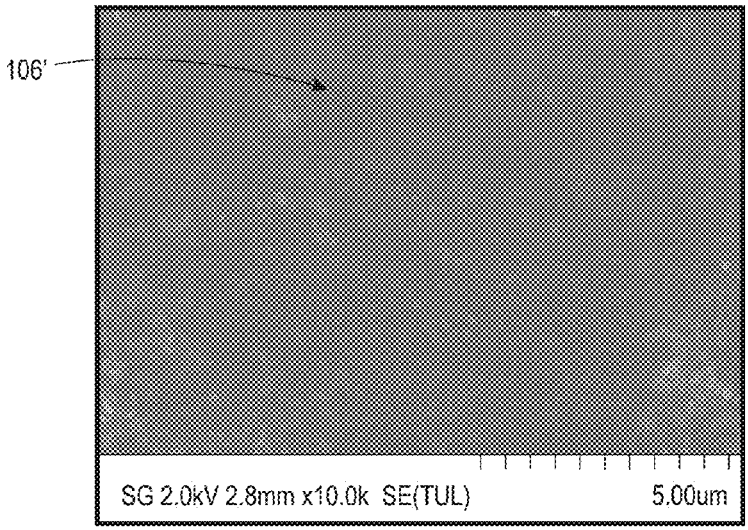
FIG. 2A is an SEM image showing a top view of a stretchable, conductive silver nanoparticle film after being stretched, according to an embodiment of the present disclosure.
Figure 2B:
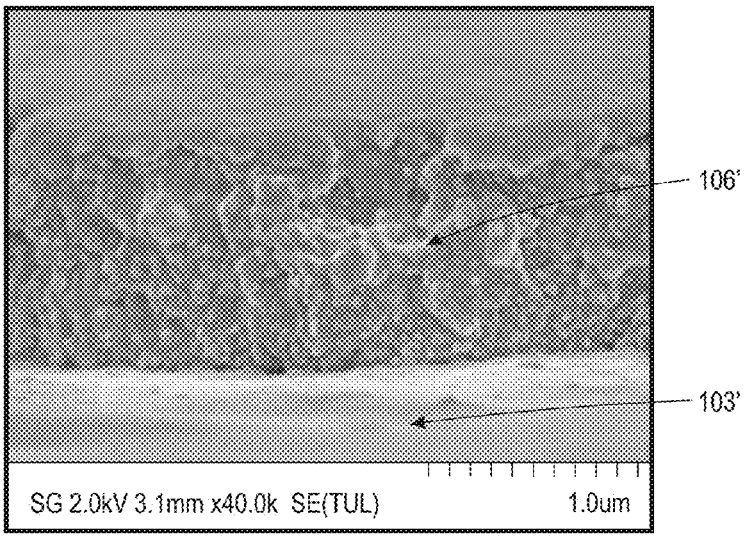
FIG. 2B is an SEM image showing a cross section of the stretchable, conductive silver nanoparticles film of FIG. 2A and the underlying substrate on which it is disposed.

Characterization of the Stretchable, Conductive Film:

A stretched conductive film was evaluated by SEM. Top and a cross sectional views are shown in FIGS. 2A-2B. Large areas of the silver film 106' remain crack free after stretching, indicating some elastic properties in the silver film. The thickness of the stretched conducting film was about 1 μm as shown in FIG. 2B. The silver film is very dense with "glue-like" material in the film. While not limited to any particular theory, it is believed that the "glue-like" material observed in the silver film 106' of FIG. 2B includes polymeric material incorporated into the silver film from the substrate surface as a result of solvent attack during deposition of the silver nanoparticles composition that is used to form the substrate surface. Accordingly, while not limited to any particular theory, it is believed that the "glue-like" material comprising portions of the substrate material could provide the annealed silver nanoparticles film with elastic property, thereby providing a stretchable, conductive film. Thus, in an embodiment, the silver nanoparticles film 106' may comprise a polymer distributed throughout the film, and the polymer can be provided to the silver nanoparticles from the substrate.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

While the present teachings have been illustrated with respect to one or more implementations, alterations and/or modifications can be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompasses by the following claims.

What is claimed is:

1. An article of manufacture comprising:

a stretchable substrate comprising a polyester modified polyurethane; and a stretchable, conductive film comprising a plurality of annealed silver nanoparticles and a polyester modified polyurethane distributed throughout the conductive film, the conductive film disposed on the substrate, wherein the conductive film is formed by dispersing a plurality of organoamine silver nanoparticles in a mixed organic solvent comprising hexadecane to form silver nanoparticle ink composition, depositing a layer of the silver nanoparticle ink composition on the stretchable substrate's surface, wherein the solvent dissolves at least a portion of the substrate, and annealing the layer, wherein at least a portion of the substrate is incorporated in the conductive film, wherein the conductive film comprises a first conductivity associated with an as-annealed shape of the conductive film, wherein the film comprises a second conductivity that is greater than the first conductivity upon being stretched in at least one direction beyond the as-annealed shape.

2. The article of manufacture of claim 1, wherein the stretchable, conductive film can be stretched in at least one dimension by at least 5% of its original shape.

3. The article of manufacture of claim 1, wherein the substrate is a portion of an electronic device.

4. The article of manufacture of claim 1, wherein the solvent further comprises decalin and toluene.

5. The article of manufacture of claim 1, wherein the solvent further comprises decalin, and 1,2,4-trimethylbenzene.

6. A process for making an article of manufacture, the process comprising:

forming a silver nanoparticle ink composition by dispersing organoamine stabilized silver nanoparticles in a mixed organic solvent comprising hexadecane;

forming a stretchable, conductive film comprising a plurality of annealed silver nanoparticles and a polyester modified polyurethane distributed throughout the conductive film by:

depositing a layer of the silver nanoparticle ink composition on a substrate surface, wherein the substrate surface comprises a polyester modified polyurethane, and wherein the solvent of the silver nanoparticle ink composition dissolves at least a portion of the substrate's surface to form the polyester modified polyurethane distributed throughout the conductive film, and annealing the layer to form the annealed silver nanoparticles, wherein the stretchable, conductive film comprises an as-annealed shape and a first conductivity associated with the as-annealed shape; and stretching the stretchable conductive film such that it attains a second conductivity that is greater than the first conductivity.

7. The process of claim 6, wherein the first conductivity is more than about 5,000 S/cm.

8. The process of claim 6, wherein the stretchable, conductive film can be stretched in at least one dimension by at least 5% of its as-annealed shape.

9. The process of claim 6, wherein the solvent comprises a solvent that attacks the substrate surface at a temperature in the range of about 30° C. to about 90° C.

10. The process of claim 6, wherein the solvent further comprises decalin and toluene.

11. The process of claim 6, wherein the solvent comprises from about 40 weight percent to about 60 weight percent of the ink.

12. The process of claim 6, wherein the first conductivity is more than about 10,000 S/cm.

13. The process of claim 6, wherein the first conductivity is more than about 5,000 S/cm and the second conductivity is more than about 5,000 S/cm.

14. An article of manufacture comprising:

a polyester modified polyurethane surface and a stretchable, conductive film disposed on the polyester modified polyurethane surface, the stretchable, conductive film comprising a plurality of annealed conductive metal nanoparticles and a polyester modified polyurethane distributed throughout the conductive film, wherein the conductive film is formed by dispersing a plurality of stabilized nanoparticles in a mixed organic solvent comprising hexadecane to form an ink composition, depositing a layer of the ink composition on the polyester modified polyurethane surface, wherein the solvent dissolves at least a portion of the polyester modified polyurethane surface; and annealing the layer, wherein at least a portion of the polyester modified polyurethane surface is incorporated in the conductive film;

wherein the conductive film comprises a first conductivity associated with an as-annealed shape of the stretchable, conductive film, and wherein the conductive film comprises a second conductivity that is greater than the first conductivity upon being stretched in at least one direction beyond the as-annealed shape.

15. The article of manufacture of claim 14, wherein the metal nanoparticles comprise silver nanoparticles.

16. The article of manufacture of claim 14, wherein the metal nanoparticles comprise one or more selected from the group consisting of Ag, Al, Au, Pt, Pd, Cu, Co, Cr, In, Ag—Cu, Cu—Au, and Ni nanoparticles.

17. The article of manufacture of claim 14, wherein the polyester-modified polyurethane surface on which the stretchable, conductive film is disposed comprises a foldable surface, a stretchable surface, or a twistable surface.

18. The article of manufacture of claim 14, wherein the adhesive force between the conductive film and the polyester-modified polyurethane surface is larger than the cohesive force of the conductive film itself.

19. The article of manufacture of claim 14, wherein the article of manufacture is an electronic device.

* * * * *